US006286209B1

(12) United States Patent
Mitra et al.

(10) Patent No.: US 6,286,209 B1
(45) Date of Patent: Sep. 11, 2001

(54) METHOD OF MAKING SMOOTH CONTACT TERMINALS

(75) Inventors: Niranjan K. Mitra, Eindhoven; Petrus W. H. Schalk, Drunen, both of (NL)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/077,571

(22) PCT Filed: Dec. 2, 1996

(86) PCT No.: PCT/US96/19157

§ 371 Date: Dec. 21, 1998

§ 102(e) Date: Dec. 21, 1998

(87) PCT Pub. No.: WO97/20369

PCT Pub. Date: Jun. 5, 1997

(30) Foreign Application Priority Data

Dec. 1, 1995 (EP) ..... 95203317

(51) Int. Cl.[7] ..... H01R 43/04

(52) U.S. Cl. ..... 29/882; 29/874; 72/462; 72/476; 72/479

(58) Field of Search ..... 72/476, 479, 462, 72/394; 29/874, 882

(56) References Cited

U.S. PATENT DOCUMENTS 1,505,409 * 8/1924 Mueller et al. ..... 72/476 X
2,779,011 * 1/1957 Deakin .
3,142,891 * 8/1964 Travis .
3,559,604 * 2/1971 Ruehleman et al. .
3,669,054 * 6/1972 Desso et al. .
4,546,542 * 10/1985 Proud .
4,678,262 * 7/1987 Reichardt et al. .
6,012,942 * 1/2000 Volstorf .
6,021,568 * 2/2000 Volstorf .

FOREIGN PATENT DOCUMENTS

576851 * 6/1959 (CA) ..... 72/398
67867 * 3/1958 (FR) ..... 72/398
1398164 * 6/1975 (GB) .
654996 * 3/1979 (RU) .

* cited by examiner

*Primary Examiner*—Carl J. Arbes
(74) *Attorney, Agent, or Firm*—Steven M. Reiss

(57) ABSTRACT

Method of producing a contact terminal (1; 17; 18; 35; 36; 60) provided with a least a first contact surface (4; 25; 26; 64) for contacting e.g. a mating contact area (6; 18; 17) including at least the following steps: a) stamping the contact terminal from a) piece of blank having a substantially flat surface with a predetermined first width, said first contact surface (4; 25; 26; 64) being substantially perpendicular to said flat surface; b) pressing said first contact surface (4; 25; 26; 64) against a first, highly polished surface (27; 66) of a support tool (16), said first polished surface (27; 66) having a first predetermined shape; c) exerting a first predetermined force on said contact terminal in order to deform said first contact surface (4; 25; 26; 64) against said first, highly polished surface (27; 66) of said support tool (16), thus polishing said first contact surface.

20 Claims, 7 Drawing Sheets

METHOD OF MAKING SMOOTH CONTACT TERMINALS

BACKGROUND OF THE INVENTION

1. Field of the Invention

The invention relates to a method of producing a contact terminal provided with at least a first contact surface for contacting with a mating contact area, comprising at least the step of stamping the contact terminal from a flat blank metal having a substantially flat surface with a predetermined first width, the first contact surface being substantially perpendicular to the flat surface.

2. Brief Description of Prior Developments

Such a method is known in the connector manufacture industry. In this industry, it is fully acknowledged that the opposing contact members need to have low surface roughness for reduced wear to ensure a low (stable) contact resistance even after many operational mating cycles. To achieve the desired connector performance, not only are the topography and coating thickness of the plating on contact surfaces of importance, but also the surface roughness of the underlying substrate contact material. It is well known that the intrinsic surface roughness of a copper alloy strip, as received from the material vendor after milling operation, has along the plane of rolling a low roughness value of the order of one-tenth of a micrometer. In-coming material inspection for this parameter, among others such as dimension and tensile strength etc., is a primary means to predict future performance and usability, for sophisticated connector applications.

Once this material is fed to a die for stamping operation to produce a contact terminal of pre-determined shape, its roughness increases in areas where it has been in contact with die tooling. The resulting roughness depends on the surface roughness of the tool used and any associated die operation (i.e. bend, coin, slug punch-out etc.). In these typical die operations, for example material drag through opposing die-platen results in the least increase in roughness. Contrary to this, for areas which have been subjected to a punch or cut-out operation, a substantial roughness increase (burr) formation is expected. This is attributed to shear-fracture crack-propagation related to a complex function of material thickness, material properties, stamping speed and the dimensional difference (clearance) between the punch and die recess. As is known to persons skilled in the art, any resultant stamped edge is imperfect. Under normal circumstances, this fractured edge, due to its high roughness, without further precautions is unsuitable as a contacting surface of the connector members as applicable in electrical connector manufacture.

The resulting roughness and burrs or undulating peaks on such contact surfaces can be somewhat smoothened by coating the terminal with a predetermined suitable metal (e.g. gold). However, in the case of opposing contact beams of a dual beam tuning-fork type terminal, the gap size cannot be made smaller than about 0.8 mm. Such gaps are required to ensure adequate electrolytic fluid movement, hence allowing metal deposition on the contacting surfaces. In such a process, one could electrolytically deburr or etch the beams locally in the gap area. However, as a final part of this process one needs to decrease the gap for example by bending the terminal beams more angularly towards each other. However, with such a process the contact surface width is equal to the original material thickness, i.e., about 0.2 mm. Since a male type terminal is often a pin with a rectangular cross section with a width of about 0.4 mm, such 0.2 mm wide contact surfaces of the tuning-fork type terminal (with a width at contact surface substantially similar to that of the pin) would act like a "knife" on the plated coating of the mating male terminal. For a typical male type terminal having a circular cross section such tuning-fork type terminals are not suitable at all since they would slip away from the surface of the mating male terminal unless such pins are constrained, for example, by the housing cavity.

To avoid problems of contact surface roughness and relatively smaller contact surface width, conventionally connector designers prefer to locate the contact surface of contact terminals along the flat-rolled plane of the material. One example of such a prior art contact terminal is a box-type contact terminal 41, as is schematically shown in FIG. 1*b*. The stamping is in such a way as to have a U-shaped cross section. Such a box-type terminal 41 is provided with a dual-beam receptacle contact with two opposing cantilever spring beams 42, 43 having a specific gap (under-size) to cooperate with a mating (over-size) male pin (not shown in FIG. 1*b*), to result in a specified contact normal force. If the cross-section of the mating pin is round in the contact area, the opposing receptacle contact zone is flat. Should the pin be substantially flat over the contact zone, the corresponding contact area of the receptacle needs to be curved—which in practice usually is a spherical dimple (not shown) on the flat-rolled portion of stamped strip cantilever beams 42, 43 of this dual-beam contact.

Besides positioning receptacle (female-type) and pin (male-type) contacts in plastic housings of a connector, cavity entry lead-in geometry openings for the connector are important to mutually guide opposing mating connector parts during insertion/withdrawal cycling. Additional provision on the terminals to facilitate appropriate contact mating is to have a lead-in entry throat for the receptacle contact, to cooperate with the taper at the extremity of the pin.

SUMMARY OF THE INVENTION

The manufacture of box-type terminals 41 in FIG. 1*b* involves usually three process steps: a pre-stamp, plating (involving precious metal deposit of at least a substantially large portion of the flat-rolled surface of cantilever beams 42, 43), and a final-stamp operation including an accurate gap-sizing operation to form the box-shaped base of contact beams. Such contacts are stamped adjacent to each other joined by a common carrier strip, at a pitch defined by the span of the cantilever beams 42, 43 in the flat state. It will be known to a skilled practitioner that besides a relatively high strip material and precious metal utilization, the number of process steps and speed of operation (due to larger pitch between adjacent terminals on the carrier), contribute towards a less cost-effective connector manufacture. Further, the dimensions of the box-section of such terminals are limiting to connector pitch reduction to cater to the general drive for miniaturization of electronic circuitry. Finally, each of the cavities of a connector containing several such U-shaped dual beam box contacts located adjacent to each other, although separated by an insulating wall, are rather close to one another, thus, increasing mutual crosstalk in high-speed electrical connector applications.

With the current requirements for higher number of signals per printed circuit board surface area (and also with reduced cabinet volume) together with a substantial increase in electronic signal clock frequencies and stringent shielding requirements, alternatives to the dual-beam box contact terminals are desirable. Further such concept should simultaneously permit less mutual signal coupling between adjacent contacts. In this light, an attractive already known tuning-fork concept, as shown in FIG. 1*a* can be used.

The conventional tuning-fork type contact terminal 1, shown in FIG. 1*a*, is accommodated within a cavity of a connector 31 shown in cross section. Contact terminal 1 is provided with two opposing beams 2, 3 which are provided with contact surfaces 4, 5 for contacting a mating contact terminal, e.g., male type terminal 6 (shown in FIGS. 2*a*, 2*b*, 2*c*). For contact mating with mate type terminal 6, the latter is inserted along a centre line axis x of the tuning-fork terminal 1, symmetrically located between the two beams 2, 3. In order to facilitate the insertion of a mating male type terminal 6, the contact surfaces 4, 5 are provided with widened throat lead-in parts 4', 5', as shown in FIG. 1*a*.

Since the material thickness for tuning-fork is similar to that used for a box-type terminal 41, the cantilever beams 2, 3 of the tuning-fork type terminal 1 are stiffer due to the new moment of inertia as applicable in the theoretical force deflection equation (i.e. longer cantilever beam length or reduced material thickness or a combination thereof is required for the same normal force requirement), a positive contribution to miniaturization can be realized. Since the stamping operation involves punch-cutting to form the contact gap between contact surfaces 4, 5, accurate gap-size control (as required to satisfy contact normal force and maintain the insertion/withdrawal forces within accepted limits), can be affected. However, the contact zone in the tuning-fork concept is located on the stamped (burred) edge of the cantilever beams. The high roughness resulting from the shear fracture, as explained above, inadvertently gives an accelerated wear on the contacting interface. Experimentation has shown that connections made by such contacts, by proper contact alignment procedure, can withstand at best only 20 cycles before plating rupture occurs, thus rendering a connection failure. Hence, although the tuning-fork concept would appear to fulfill the requirement towards contact (hence connector) miniaturization and high speed electronic circuitry applications, it fails to satisfy the prerequisite of having a smooth (low predictable roughness) contact surface to endure connector cycling operations (a minimum of 200 cycles in telecommunication environment), expected with high performance connectors.

Additional, practical difficulties with the tuning-fork concept will be discussed with reference to FIGS. 2*a*, 2*b*, and 2*c*.

FIG. 2*a* shows a cross section to the two beams 2, 3 when electrically and mechanically contacting the mating terminal 6, which may be provided with a point shaped end 7 in order to facilitate insertion between the two beams 2, 3. In FIG. 2*a* the 'ideal' situation is shown in which the two beams 2,3 are still within one plane and the mating terminal 6 is inserted along the centre line axis x. Contact surfaces 4, 5 of beams 2, 3 are shown with rough surfaces provided with burrs due to the stamping process used to manufacture the contact terminal 1.

Apart from the presence of burrs and non-flat contact surfaces 4, 5 the contacting situation shown in FIG. 2*a* may be said to be relatively ideal for two reasons:

a. the axis of the mating contact terminal 6 substantially coincides with the centre line axis x (FIG. 1*a*); consequently the normal force can be distributed over the microscopic asperities shown, although this will then result in high local pressure at these asperity sites;

b. the material thickness of the beams 2, 3 of the contact terminal 1, as shown in FIGS. 2*a*, 2*b*, and 2*c*, is equal to or larger than the effective width of the mating contact terminal 6 in the contact area. It needs to be emphasized that the objective of a skilled connector designer is to have a contact surface of the receptacle terminal to be substantially larger than the surface of the contacting pin at the interface.

However, in reality often a less ideal situation occurs. FIG. 2*b* shows a situation in which beams 2, 3 are still substantially within one plane but in which terminal 6 is displaced relative to centre line axis x. FIG. 2*c* shows a situation in which not only the mating terminal 6 is displaced but also one of the beams 2, 3 is displaced by an amount $\Delta x$ relative to the centre line axis x. The latter displacement is often the result of die maladjustment in the stamping operation.

Both in the situation according to FIGS. 2*b* and 2*c*, the possibility of a "sharp" corner of one of the beams 2, 3 riding on mating terminal 6, is large. This inadvertently results in the rupture of terminal plating in the middle of the terminal 6, indicated by reference number 52, thus impairing the performance of the connection between the contact terminals 1 and 6. In situations as shown in FIGS. 2*b* and 2*c*, investigations have shown that the number of connecting and disconnecting cycles may be as low as 2 cycles.

The teachings of the prior art show an alternative using a tuning-type for terminal 51 having the twisted cantilever beams 52, 53, as shown in FIG. 1*c*. Similar twisted beam contact terminals are, for example, shown in U.S. Pat. Nos. 4,473,208 and 5,199,886. Such twisted beam contact terminals 51 take the advantage of tuning-fork concept, and by twisting the cantilever beams 52, 53 through 90 degrees the contact surfaces 54, 55 become, essentially, the initially mill-rolled surface of the strip material with reduced surface roughness from which the terminal 51 is produced. However, in practice the concept of twisted beam contact terminals shows the following associated difficulties:

a. it is difficult to twist the beams of the tuning-fork type terminals after initial stamping, due to the small mutual spacing and low pitch between adjacent terminals (after stamping all terminals are connected side-by-side to a common connecting carrier);

b. twisting of the beams can only successfully be performed on high tensile, relative expensive cupro nickel or beryllium copper material and not the relatively inexpensive phosphor bronze copper material which is commonly used in the connector industry. When twisting phosphor bronze, cracks will initiate in the material at the roots of the beam twist. This will ultimately result in a loss of contact normal force during connector use;

c. the accuracy of the gap size resulting after twisting the opposing beams of the terminal, is difficult to control during fast stamping operation.

Besides the associated disadvantages of rough and burred contact surfaces, use of tuning-fork type terminals have many inherent advantages. Consequently, the application of (flat) stamped tuning-fork type terminals deserves to be pursued, provided their associated disadvantages can be overcome. Compared to box type terminals tuning-fork type terminals can be stamped with an easier process, and the contact pitch on the carrier can be smaller, e.g. 2 mm, resulting in less material used per terminal. Moreover, when tuning-fork type terminals are inserted in the connector housing for a multi-row multi-column connector, a larger mutual spacing between adjacent terminals is obtained than would be the case with box-type terminals. Consequently, for the case of tuning-fork type terminals the coupling between adjacent contacts (cross-talk) for high frequency applications is reduced. Therefore, the use of tuning-fork type terminals has some merits over box type terminals in future connector applications.

Apart from this specific demand related to tuning-fork type terminals, there is a general need to smooth contact surfaces of terminals where these contact surfaces are obtained by stamping operations and are defined as the edges perpendicular to the direction of stamping.

Therefore, it is a primary object of the present invention to provide a method of polishing such contact surfaces in general.

It is a further object of the invention to provide a method of polishing opposite contact surfaces of dual-beam tuning-fork type terminals such that a well defined gap size is obtained. Preferably, in such a process, the effective contact surface is larger in width than the initial stock width.

It is also an object of the present invention to provide a method to form a polished contact surface contour of press-fit terminals, preferably with a "flared" cross-section, i.e. an increase in width of material thickness towards the outside.

A still further object of the invention is to provide contact terminals with polished contact surfaces and products comprising such contact terminals, the terminals being made from thin, e.g. in a range of up to 1.0 mm, flat stock material.

The primary object mentioned above is achieved by utilization of a method according to the preamble of claim 1 characterized by the following steps:

- pressing the first contact surface against a first, highly polished surface a support tool, the first polished surface having a first predetermined shape;
- exerting a first predetermined force on the contact terminal in order to deform the first contact surface against the first, highly polished surface of the support tool, thus, polishing the first contact surface.

By this method, the original rough contact surface will be highly polished due to pressing against the highly polished surface of the support tool, thus avoiding the disadvantages related to the prior art rough contact surfaces.

Preferably, the first predetermined force is exerted such and the first predetermined shape is such that after the last step the first contact surface is provided with a second width larger than the first width. Thus, the previously "knife" action of the contact surface during contact mating can be avoided.

In one embodiment, the method relates to the manufacturing of tuning-fork type terminals. Then, the contact terminal furthermore comprises a second contact surface being substantially perpendicular to the flat surface and opposite to the first contact surface for providing a gap for receiving a mating contact terminal, the method additionally comprising the following steps:

- pressing the second contact surface against a second, highly polished surface of the support tool, the second polished surface having a second predetermined shape;
- exerting a second predetermined force on the contact terminal in order to deform the second contact surface against the second, highly polished surface of the support tool, thus, polishing the second contact surface.

By producing tuning-fork type terminals in this way, also a very accurate controlled gap size between the first and second contact surfaces is obtained, since the gap size is determined by the support tool.

Preferably, the second predetermined force is exerted such and the second predetermined shape is such that after the last step the second contact surface is provided with a third width larger than the first width.

This first surface of the support tool may have any desired shape but in one embodiment it is designed to shape the first contact surface such that a line of intersection between the first contact surface and a plane of cross section through the contact terminal and perpendicular to the flat surface, is substantially rectilinear.

Moreover, the second surface of the support tool may be designed to shape the second contact surface such that a second line of intersection between the second contact surface and the plane of cross section is substantially rectilinear. Such a shape is preferred for a connector configuration with round cross-sectional pin members.

Alternatively, the first surface of the support tool may be designed to shape the first contact surface such that a line of intersection between the first contact surface and a plane of cross section through the contact terminal and perpendicular to the flat surface, is substantially curved. Then, also the second surface of the support tool is, preferably, designed to shape the second contact surface such that a second line of intersection between the second contact surface and the plane of cross section is substantially curved. Such a shape is preferred for a connector configuration with rectangular cross-sectional pin members.

The polishing and possible broadening of the contact surfaces may be done with specially shaped punches. These punches may be moved either substantially parallel to the flat surfaces of the terminal or substantially parallel to the flat surfaces of the terminal and towards the highly polished surface(s) of the support tool to exert the forces required for polishing and possible broadening of the contact surfaces.

The present invention is also applicable to press-fit terminals, as will be explained below.

Press-fitting connectors to printed circuit boards (pcb) is common practice. Current technology trends with use of multi-layer boards in electronic circuitry for high density I/O requirements, dictate small pitch connector use. Consequently, often the press-fit tail portion is connected to a thin stock connector terminal. Further, the press-fit terminal is often located on a tail portion which is at a 90° angle to the axis of the receptacle terminal axis, e.g. for use in right-angle connectors. In such extreme cases, a major difficulty can be experienced during positioning and press-fit application to printed circuit boards. In particular, the tooling and means to perform the press-fitting, including force transmission to the press-fit end, can be critical. Careful balance between the design parameters needs to be undertaken by analyzing the plug/receptacle insertion/withdrawal forces, means of application of the connector to the board, damage to plated through holes in the board and stress relaxation at the junction of the press-fit spring member to the plated through-hole in the pcb.

Press-fit terminals for relatively large pitch spacings, as in the past, were primary square (solid) in cross-section. The diagonal over-size with the plated through hole (PTH) resulted in an effective measure to maintain the electrical/mechanical integrity of the press-fit connection. Primarily, the elasto-plastic mechanical deformations and board material characteristics defined the press-fit section retention force values. However, such press-fit systems with solid press-fit terminals can generally be associated with high insertion forces, local board bow and potential danger for PTH plating rupture to impair the connection quality. These factors are of particular concern in the application with multi-layer boards. Consequently, the engineering thought behind the development of special resilient press-fit terminals is clear. Several designs have been adequately registered in patent literature.

Of special interest here is the development of press-fit connections from thin stock materials. However, a main requirement remains that a minimum retention force at the press-fit surface interface is desired to ensure connection integrity. The transition of the contact with the press-fit zone of such thin stock material is relatively weak and insertion difficulties need to be anticipated in the design of the terminal. Again, since the material is thin the edges easily cut-though the PTH plating to impair the quality of the electromechanical junction. Hence, besides designing for resilience (and avoiding spring over-stress of press-fit section during application and use) there is a need to increase the mutual area of contact between the press-fit terminal and the plated through hole in the printed circuit board. This would reduce the local stress, avoiding rupture of the through hole plating.

Therefore, the method defined above also relates to press-fit terminals which furthermore comprises a second contact surface being substantially parallel and opposite to the first contact surface, the first and second contact surfaces being arranged for a press-fit connection to a plated through hole of, e.g., a printed circuit board, the method steps defined above additionally comprising the following steps:

pressing the second contact surface against a second, highly polished surface of the support tool, the second surface having a second predetermined shape;

exerting a predetermined force on the press-fit terminal in order to deform the second contact surface against the second, highly polished surface of the support tool, thus, polishing the second contact surface and, preferably, providing it with a third width being larger than the first width, e.g., a tapered or flared cross-section.

Preferably, in such a press-fit terminal the first surface of the support tool is designed to shape the first contact surface such that a first line of intersection between the first contact surface and a plane of cross-section through the contact terminal and perpendicular to the flat surface, is substantially curved and/or the second surface of the support tool is designed to shape the second contact surface such that a second line of intersection between the second contact surface and the plane of cross-section is substantially curved.

The invention also related to a contact terminal provided with at least a first contact surface for contacting a mating contact area and stamped from a piece of blank having a substantially flat surface with a predetermined first width, the first contact surface being substantially perpendicular to the flat surface and being highly polished.

Preferably, the first contact surface is provided with a second width larger than the first width.

The contact terminal according to the invention may furthermore be provided with a second contact surface being substantially perpendicular to the flat surface and opposite to the first contact surface for providing a gap for receiving a mating contact terminal, the second contact surface being highly polished.

Preferably, the second contact surface is provided with a third width larger than the first width.

Such a contact terminal may be a press-fit terminal with highly polished and possibly broadened contact surfaces.

The invention also relates to a connector provided with at least one contact terminal either as produced by any of the methods described above or as defined above.

Finally, the invention relates to an assembly of a substrate and at least one contact terminal either as produced by any of the methods described above or as defined above, the at least one contact terminal being fixed to the substrate.

The invention will now be explained with reference to some drawings which are intended to illustrate and not to limit the scope of the invention.

DETAILED DESCRIPTION OF THE PREFERRED EMBODIMENTS

Figure 1A:
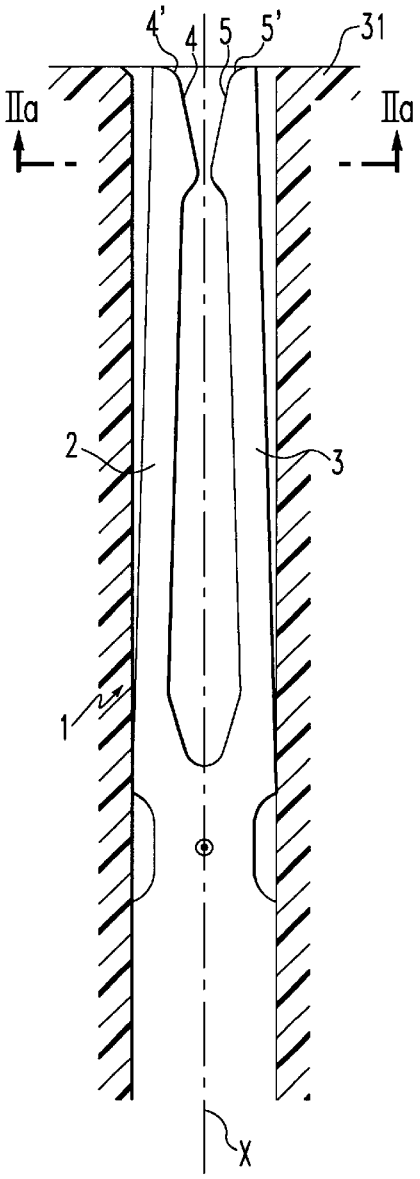
FIGS. 1*a*, 1*b*, and 1*c*, respectively, show a tuning-fork type contact terminal, a box-type contact terminal and a twisted beam tuning-fork type terminal, respectively, according to the prior art.
Figure 2A:
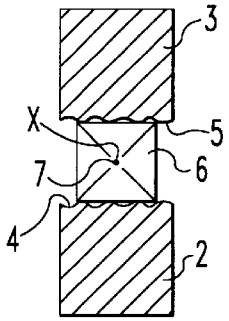
FIG. 2*a* shows a lateral sectional view of the contact terminal according to FIG. 1*a* along line IIa—IIa, when in electrical contact with a mating male type contact terminal.
Figure 2B:
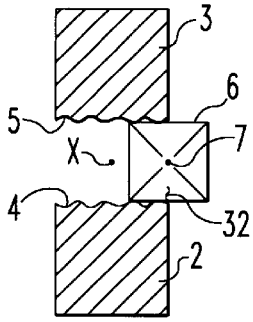
FIGS. 2*b*, 2*c* show alternative lateral sectional views of the contact terminal according to FIG. 1*a;*
Figure 2C:
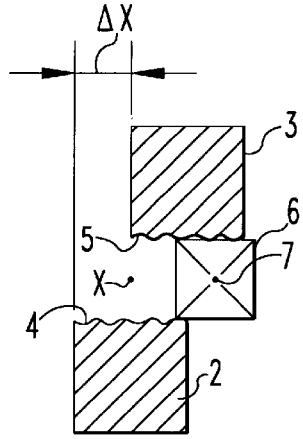
Figure 3A:
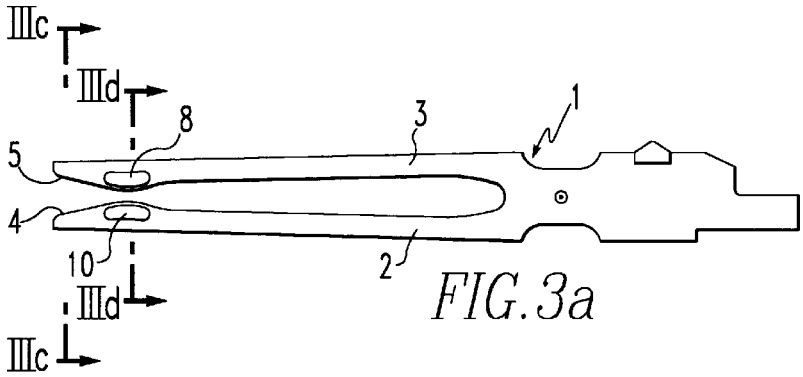
FIG. 3*a* shows a side view of a tuning-fork type contact terminal according to the invention.
Figure 3B:
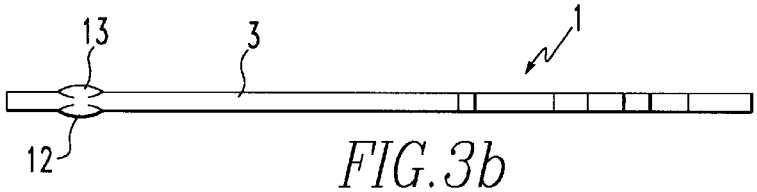
FIG. 3*b* shows a top view of the contact terminal according to FIG. 3*a;*
Figure 3E:
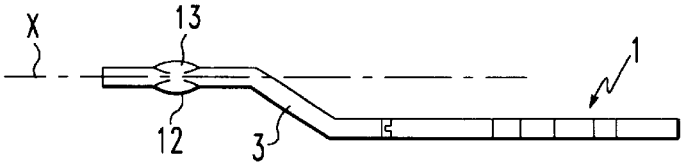
FIG. 3*e* shows an alternative top view of the contact terminal according to FIG. 3*a;*

In FIG. 3*a*–3*e* a turning-fork type terminal 1 according to the invention is shown. It is similar to the prior art terminal of FIG. 1*a* besides the presence of dimples 8–11 and extension 12–15 which result from the manufacturing process. FIG. 3*a* shows a side of the terminal 1 intended for FIG. 3*b* show a top view of the front side of the terminal 1 intended for connection to mating terminal 6 (FIGS. 2*a*–2*c*). In FIG. 3*b* one can see the extensions 12, 13 from beam 3. FIG. 3*e* show a top view of terminal 1 in an alternative embodiment in which the beams 2, 3 are curved relative to centre line axis x such that the bottom part of the stagger shaped terminal does not coincide with the centre line axis x. Thus, in the embodiment according to FIG. 3*e*, a mating pin-like terminal 6 may be inserted deeper between beams 2, 3 without being stopped by the bottom part of the terminal 1. Consequently, existing relatively long pin-like terminals 6 can be received by terminal 1 even when beams 2, 3 are shorter than in the prior art tuning-fork type terminals.

Figure 3C:
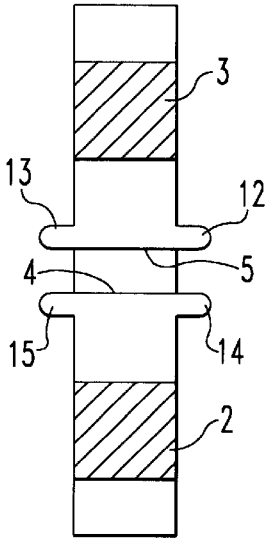
FIGS. 3*c*, 3*d* show sectional views of the contact terminal according to FIG. 3*a* along lines IIIc—IIIc and IIId—IIId, respectively.
Figure 3D:
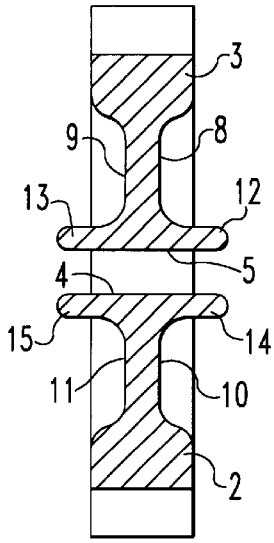

FIG. 3*c* shows a cross section through terminal 1 along line IIIc—IIIc in FIG. 3*a* whereas FIG. 3*d* shows a cross section through terminal 1 through line IIId—IIId in FIG. 3*a*. FIG. 3*d* clearly shows the dimples 8–11 above extensions 12–15 at those locations of beams 2, 3. The material surface adjoining extensions 12, 13 and 14, 15 are the receptacle surfaces intended to mate with corresponding surfaces of male pin terminal 6. The contact surfaces 4, 5 of beams 2, 3 are broadened relative to the width of the beams 2, 3 and are highly polished due to the manufacturing process which will be explained below. The width of contact surfaces 4, 5 may be less than 1.0 mm, and preferably in the range of 0.5 to 0.6 mm whereas the width of the beams 2, 3 may be 1.0 mm or less, preferably in the range up to 0.5 mm, e.g. 0.3 mm. The associated contact gap depends on the normal force requirement, usually of the order of 0.2 mm for 0.5 N force.

Figure 4A:
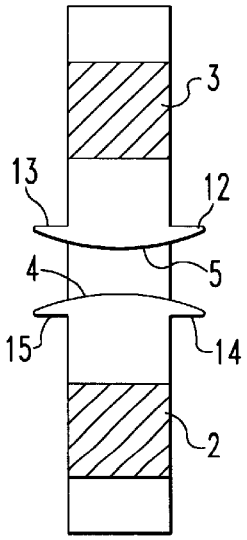
FIGS. 4*a*, 4*b* show sectional views like FIGS. 3*c*, 3*d* but of an alternative embodiment of a contact terminal according to the invention.
Figure 4B:
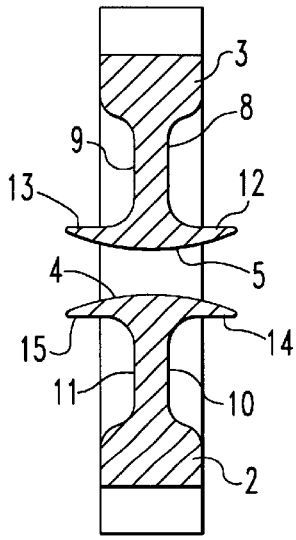

Contact surfaces 4, 5 are substantially perpendicular to the side surfaces of beams 2, 3. In the embodiment according to FIGS. 3*c*, 3*d* the lines of intersection between contact surfaces 4, 5 and the cross section plane along lines IIIc—IIIc and IIId—Illd, respectively, are rectilinear. The embodiment according to FIGS. 3*c*, 3*d* is preferred when the mating contacting terminal 6 has round cross section. However, these lines of intersection may be curved as shown in FIGS. 4*a* and 4*b* which show cross sections through terminal 1 similar to the cross sections of FIGS. 3*c* and 3*d*, respectively, however, from an alternative embodiment of the invention. The embodiment according to FIGS. 4*a*, 4*b* is preferred when mating terminal 6 has a rectangular cross section.

Instead of rectilinear or curved (either convex or concave) lines of intersection other shaped lines of intersection may be used, as desired. However, the cross sections shown in FIGS. 3*c*, 3*d*, 4*a*, 4*b* have been shown to demonstrate the principle of contact shaping and gap size definition.

Figure 5A:
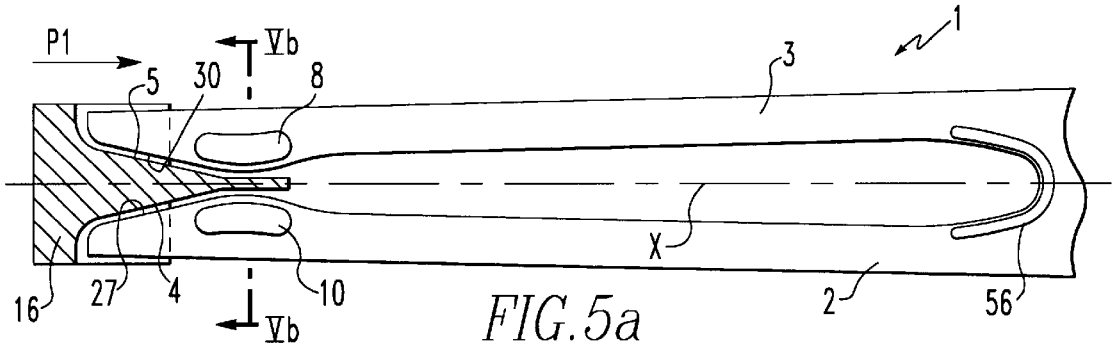
FIG. 5*a* shows the contact terminal according to FIG. 3*a* and a central support tool for the manufacturing of such a contact terminal.
Figure 5B:
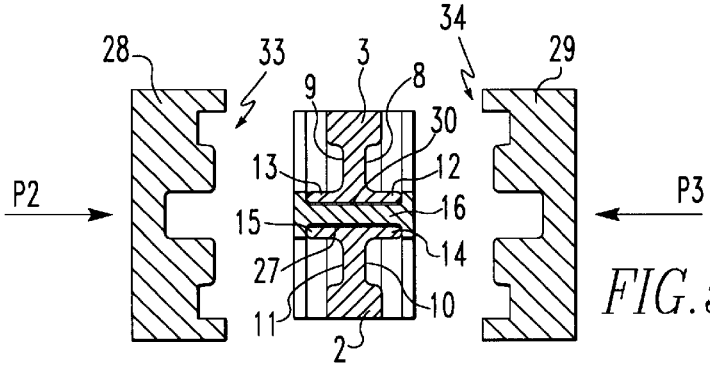
FIG. 5*b* shows a sectional view of the central support tool shown in FIG. 5*a* and a sectional view of a side support tool, which together form the contact terminal.

FIG. 5*a* shows a cross section through a specially shaped central support tool 16 used for manufacturing terminals according to the invention. FIG. 5*b* shows a cross section of specially shaped side support punches 28, 29 (not shown in FIG. 5*a*) simultaneously used with the support tool 16 in a plane perpendicular to beams 2, 3 along line Vb—Vb shown in FIG. 5*a*. One can see that the shapes of punch surfaces 33, 34 of side support punches 28, 29 correspond to the side surfaces of beams 2, 3. Surfaces 27, 30 of central support tool 16, FIG. 5*b*, are highly polished. Punch surfaces 33, 34 need not be high polished although it is well known that a smooth contour promotes material flow during a squeezing step (see below).

Now, the method of manufacturing a terminal by means of the support tool 16 and the punches 28, 29 will be described. After the tuning-fork type terminal 1 has been stamped from a piece of blank, as known from the prior art method, the support tool 16 is inserted between the beams 2, 3 of terminal 1 along centre line axis x in a direction indicated by arrow P1 until the position shown in FIG. 5*a*. Then, the side support punches 28, 29 are moved towards the beams 2, 3 in directions indicated by arrows P2 and P3, respectively. At that moment, the side surfaces of beams 2, 3 are still substantially flat (not shown). The side support punches 28, 29 are pushed against the side surfaces of beams 2, 3 and apply a predetermined force in order to locally depress and squeeze the beams 2, 3 at the side surfaces. The side support punches 28, 29 are shaped in order to prevent flow of material of beams 2, 3 in a direction away from contact surfaces 4, 5 and to force material flow towards surfaces 27, 30 of central support tool 16. Material of the beams 2, 3 is thus forced to flow by squeezing in order to fill the mutual opening between the side support punches 28, 29 and the surfaces 27, 30, thus forming extensions 12, 13, 14, 15 and dimples 8, 9, 10, 11. Since surfaces 27, 30 of central support tool 16 are highly polished the contact surfaces 4, 5 are polished by this process or at least obtain a strongly reduced surface roughness. Moreover, preferably, the widths of contact surfaces 4, 5 are enlarged relative to the widths of the beams 2, 3, thus further reducing the sharpness of the contact surfaces 4, 5. It is appreciated that the gap between contact surfaces 4, 5 remains well defined due to the use of central support tool 16. At the end of this setup, the central support tool 16 can be withdrawn (opposite to direction P1), and subsequently side support punches 28, 29 can be removed to leave a highly, flared contact surface with a predetermined gap size between contact beams 2, 3.

The shapes of central support tool 16 and side support punches 28, 29 are such that the heights of beams 2, 3 are, preferably, substantially not changed by the squeezing force. Control of the heights of beams 2, 3 is necessary since they are determined by the size of the connector cavity in which terminal 1 is to be inserted (see FIG. 1*a*). To this effect, side support punches 28, 29 are shown to have suitable extensions. However, alternatively, central support tool 16 may be provided with suitable extensions to prevent the heights of beams 2, 3 to be enlarged during the manufacturing process.

It is observed that the invention is not limited to the application of one central support tool 16 and two side support punches 28, 29 as shown. Alternatively, other numbers of punches may be used. One can also design one or more support tools which may be used. One can also design one or more support tools which are both provided with highly polished surfaces (like surfaces 27, 30) required, and shaped to allow squeezing of the beams 2, 3. For example, one can make two punches (not shown) to be moved in the directions of arrows P2 and P3, respectively, which are provided with highly polished surfaces like surface 27, 30 of central support tool 16 and with suitable shaped punch surfaces 33, 34. Such two punches, thus, act both as central support tool 16 and as side support punches 28, 29.

The previous discussion relates to the use of the invention for mating and termination (press-fit) end. However, the remaining in-between portion of the terminal edges, originally burred due to the stamping process, can also be locally polished and flared, as required. For example, the junction portion between beams 2 and 3 of the dual-beam type terminal 1 could be provided with a polished and flared edge 56, as shown in FIG. 5*a*. Providing this junction between beams 2, 3 with an enlarged width results in stiffer beams because of the increased moment of inertia, thus, providing the possibility of using less material to obtain the same stiffness as in dual-beam type terminals without such flared junction edges. Further miniaturization could thus be achieved.

In order to facilitate the flow of material and the polishing effect of the squeezing force the central support tool 16 and/or the side support punches 28, 29 may be slightly heated. Alternatively, the beams 2, 3 of terminal 1 may be slightly heated before squeezing with the support tool 16 and the punches 28, 29.

Normally, such support tooling could be a part of a comb-like structure to facilitate mass-stamping.

The invention is not restricted to dual beam contact terminals like tuning-fork type terminals. FIGS. 6 *a* and 6*b* show single beam contact terminals 17 and 18 having beams 20 and 19, respectively. In these figures, for the sake of clarity, plastic connector housings have been omitted. Beam 19 is provided with a contact surface 25 and beam 20 is provided with a contact surface 26. Contact surfaces 25, 26 are polished by the same method as used to polish the contact surfaces 4, 5 of beams 2, 3 of the tuning-fork type terminal 1. The polishing tools are essentially the same as are applied for polishing dual-beam contact terminals through they may be specially designed and manufactured. When the polishing process illustrated with reference to FIGS. 5*a*, 5*b* is used dimples 8 will result.

Figure 6A:
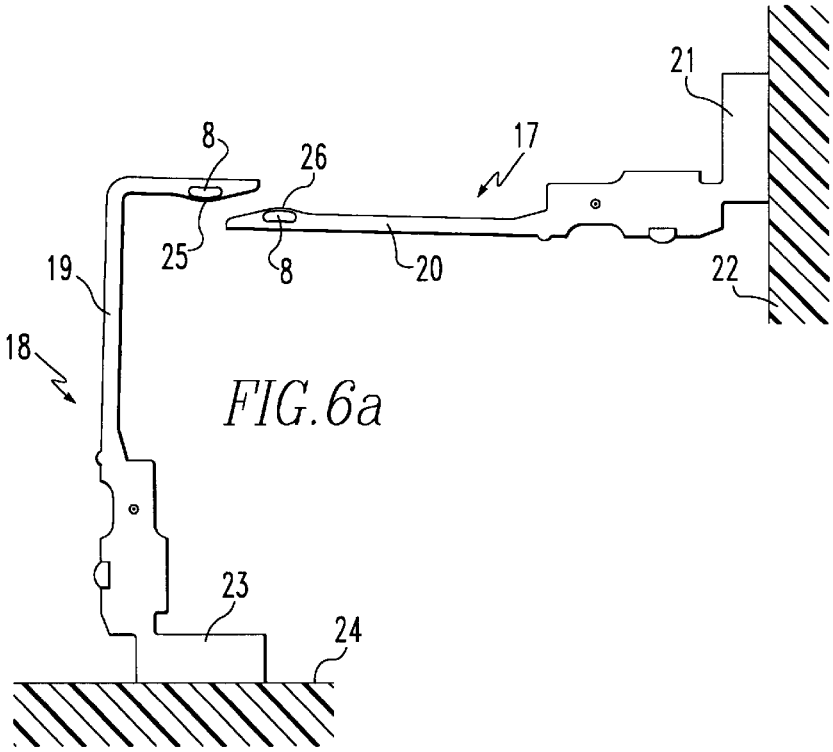
FIGS. 6*a*, 6*b* show single beam contact terminals according to the invention.

FIG. 6*a* shows a connector structure using single beam terminals 17, 18 provided with bases 21, 23 used as a means to connect two substrates 22, 24, e.g., printed circuit boards. Terminal 18 is shown to be L-shaped in order to define a blocking position for beam 17 when contacting beam 18 such that contact surfaces 25 and 26 are then touching each other in a predetermined way.

Figure 6B:
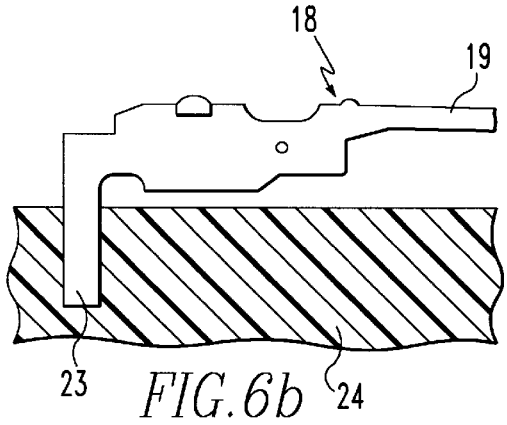

FIG. 6*b* shows a part of the same single beam terminal 18, however, the base 23 being used for a right angle connection to substrate 24.

Figure 6C:
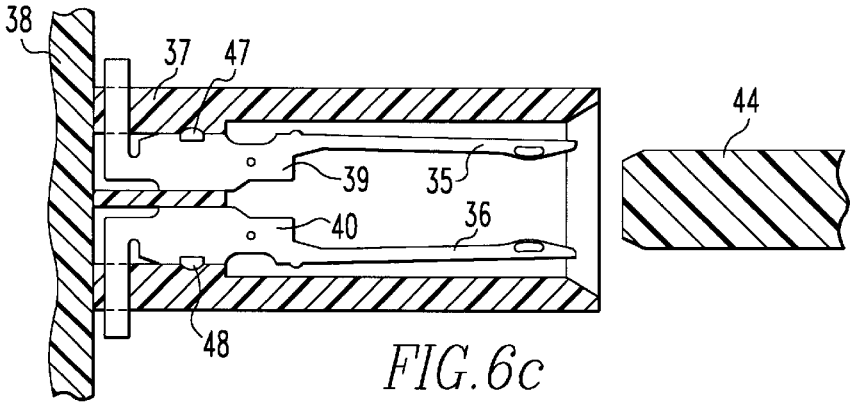
FIG. 6*c* shows single beam contact terminals in accordance with the invention, applied as an edge card connector for connecting directly to tracks of a pcb.

FIG. 6*c* shows the application of two single beam terminals 35, 36 arranged within an edge card connector 37, and suitable for connection to circuit tracks on two opposing sides of a substrate 44. Dimples 47 and 48 are provided on the terminals 35 and 36, respectively, for a firm accommodation of terminals 35, 36 within connector 37. The dimples 47, 48 may be polished, flared edge portions made by the method according to the present invention. As shown, the connector 37 may be connected to another substrate 38 provided with conducting tracks (not shown) connected to the terminals 35, 36 in a way known by persons skilled in the art, e.g., by soldering or a press-fit connection. The substrate 44 is also provided with conducting tracks (not shown) which will contact terminals 35, 36 when the connector 37 is connected to the edge of substrate 44. Preferably, the single beam terminals 35, 36 are provided with stops 39, 40 to define the insert depth of substrate 44 into edge card connector 37. Of course, connector 37 may be provided with several more single beam terminals like terminals 35, 36 in a parallel relation thereto.

Figure 6D:
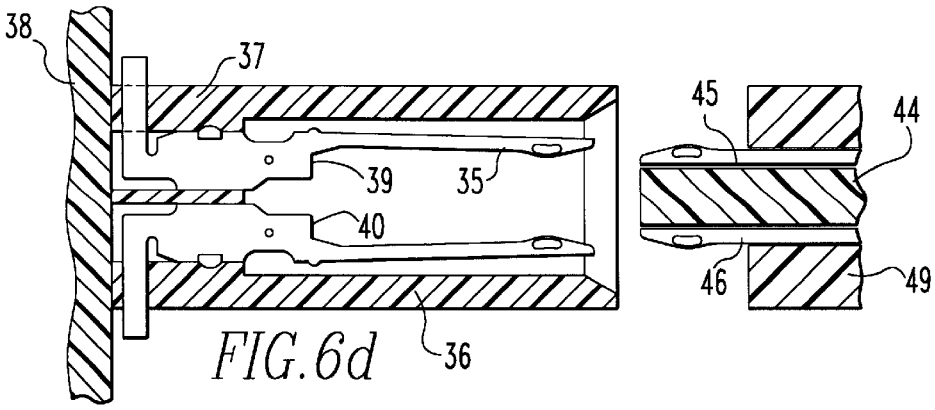
FIG. 6*d*, shows single beam contact terminals in accordance with the invention, connected to opposing surfaces of a substrate and arranged to cooperate with an edge card connector shown in FIG. 6*c;*

FIG. 6*d* shows that substrate 44 may be provided with single beam terminals 45, 46, which are similar to the terminals 35, 36 and are arranged for contacting them and are to replace the conducting tracks (not shown) on substrate 44. Reference number 49 refers to an elevation on pcb 44, arranged to define the insert depth of pcb 44 into connector 37 to ensure that the polished, and possibly flared portions of the contact surfaces of beams 35 and 36 are contacting the contact surfaces of beams 45 and 46, respectively, in the inserted state.

Figure 7A:
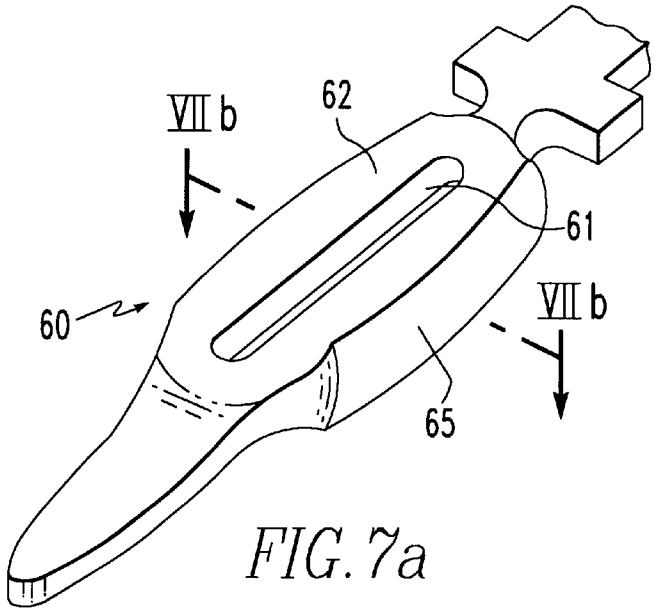
FIG. 7*a* shows a press-fit terminal with polished surfaces.
Figure 7B:
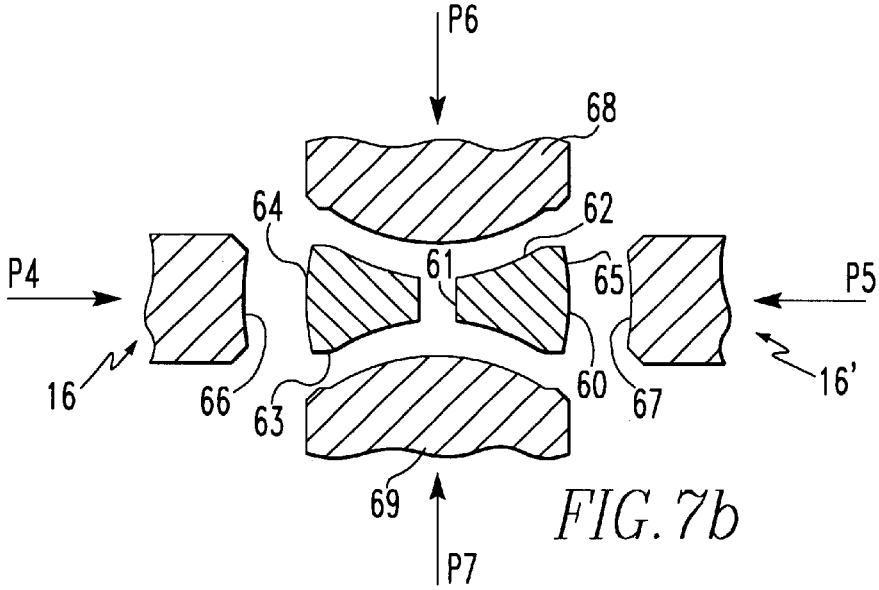
FIG. 7*b* shows a cross section of the press-fit terminal along line VIIb—VIIIb in FIG. 7*a*, as well as cross sections of a highly polished support tool and punches used to manufacture the press-fit terminal.

The invention is also applicable to press-fit tail areas, as shown in FIGS. 7*a* and 7*b*.

Any burred or rough surface of a contact terminal can be polished by the method illustrated above. FIG. 7*a* shows a press-fit terminal 60 having a slot shaped opening 61 on its centre line to resiliently absorb forces exerted on the press-fit terminal 60 when inserted into an undersized plated (through) hole of, e.g., a printed circuit board (not shown), as is known as an "eye of a needle" press-fit. However, the invention is not restricted to this type of press-fit terminal.

The press-fit terminal 60 comprises an insert part 62 with contact surfaces 64 (FIG. 7*b*) and 65 which result from stamping from a piece of blank. Thus, like the embodiments above, after the initial stamping step the contact surfaces 64, 65 are rough and burred. In a subsequent step, these rough and burred surfaces 64, 65 are polished by first pressing these surfaces 64, 65 against highly polished surfaces 66 and 67, respectively, of a support tool 16', e.g., by moving these surfaces 66, 67 in the directions of arrows P4 and P5, respectively (FIG. 7*b*). Then, punches 68, 69 are pressed against the flat upper and lower surfaces of press-fit terminal 60, as indicated in FIG. 7*b* by arrows P6 and P7, respectively. It is evident to a skilled practitioner, that by polishing the contact surfaces 64, 65 the potential risk of damage to a plated hole during the insertion of a press-fit terminal 60, can be reduced.

Preferably, the front surfaces of punches 68, 69 and the surfaces 66, 67 of the support tool 16' are shaped such that the thickness of contact surfaces 64, 65 of press-fit terminal 60 are enlarged (or flared) relative to the original thickness of flat (rolled) material from which the initial contour of t he press-fit section was cut-out. Further providing the enlarged width of contact surfaces 64, 65 has the advantage that the normal forces exerted on the wall of the plated through hole in a printed circuit board is distributed over a larger area. This then results in a reduced risk to damage of the plated through hole, contributing to good reliable electrical connection between the press-fit terminal and the plated hole.

It is appreciated that in FIGS. 7*a* and 7*b*, the press-fit terminal is shown in its state after polishing and possibly broadening (or flaring) the contact surfaces 64, 65.

Figure 1B:
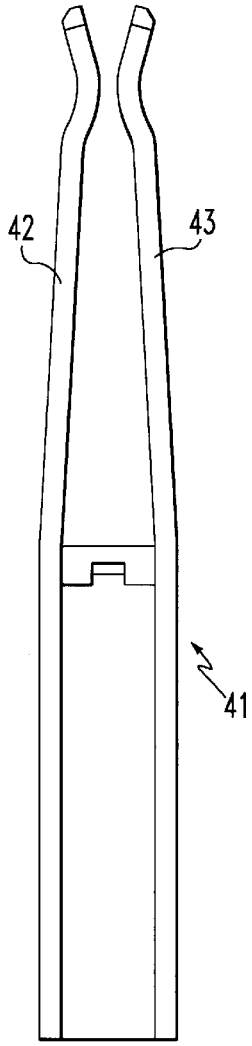
Figure 1C:
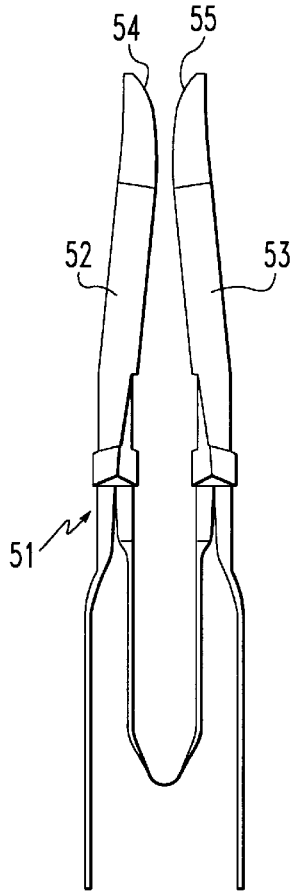

In the foregoing discussion, the invention describes essentially the use of two opposing indenting punches depressing from the flat-rolled side (i.e. along the material stock thickness and perpendicular to the material's flat surfaces), while the material extrusion is being restrained by support tooling located at the two other edges (i.e. along the width) of contact cut-out. This mode of operation has been the basis of the embodiments according to FIGS. 1 up to 7. However, there is yet another, alternative mod of operation to obtain a broadened polished contact surface. Namely, by applying the deforming forces along the width (as defined above) while restraining the material flow to a predetermined extent along the direction of the material thickness. This will be explained with reference to FIGS. 8*a* and 8*b* .

Figure 8A:
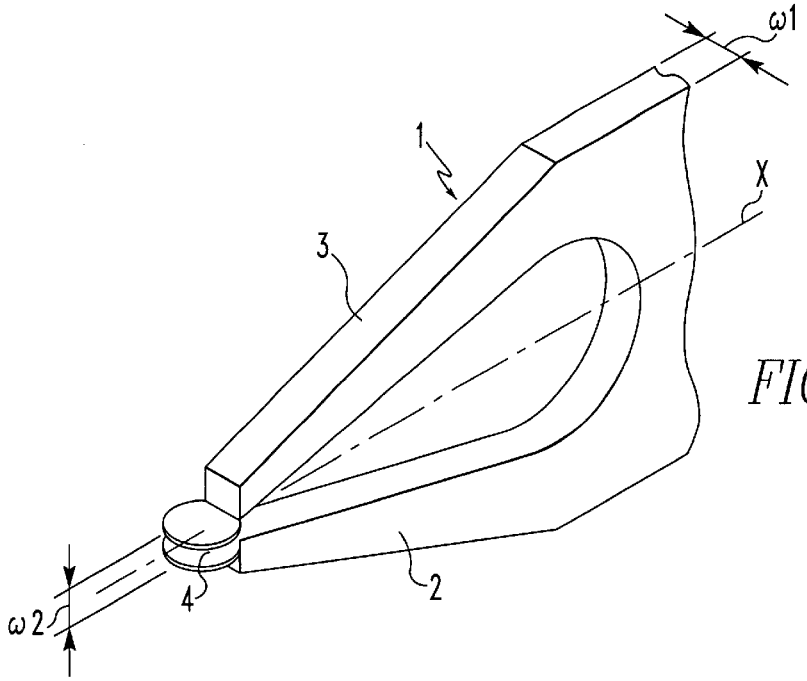
FIG. 8*a*shows an alternative dual beam tuning-fork terminal provided with polished contact surfaces.

FIG. 8*a* shows a dual-beam tuning-fork terminal 1 with beams 2, 3. Contact surfaces 4, 5 are polished and are shaped like a spoon.

Contact surfaces 4, 5 have a width w2 which is larger than the original width w1 of the terminal. W1 may be 0.3 mm or less whereas w2 may be 0.58 mm or less.

Figure 8B:
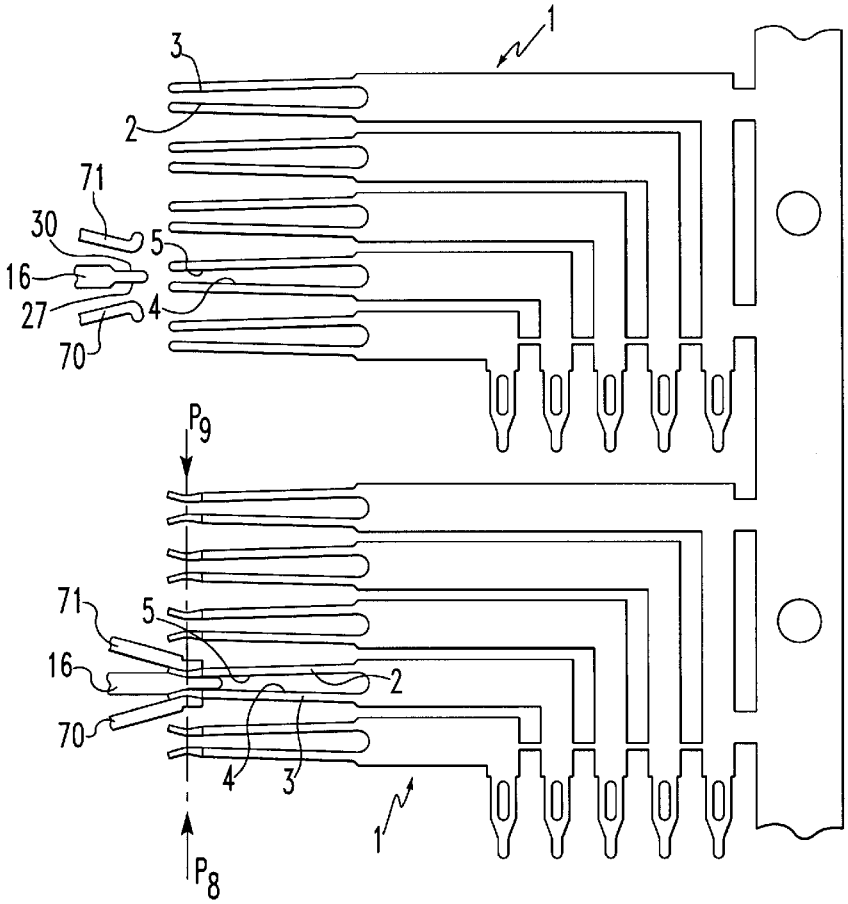
FIG. 8*b* illustrates a method of manufacturing the dual beam tuning-fork terminal according to FIG. 8*a*.

FIG. 8*b* shows how these spoon-like contact surfaces 4, 5 can be made. On the left-hand part of FIG. 8*a*, five right-angle contact terminals 1 are shown in their state after the stamping step. The beams 2 and 3, respectively, are still provided with rough, burred contact surfaces 4 and 5, respectively.

On the right-hand part of FIG. 8*b*, five right-angle contact terminals 1 provided with spoon-like contact surfaces 4 and 5 are shown. The spoon shape of contact surfaces 4, 5 is obtained by inserting support tool 16 between opposing contact surfaces 4, 5 and by pressing contact surfaces 4, 5 with a predetermined force against its highly polished surfaces 27, 30 by means of punches 70, 71. To generate such a force, the punches 70, 71 are moved in a direction towards the highly polished surfaces of support tool 16, as indicated by arrows P8, P9.

In order to be able to move punches 70, 71 in the directions of arrows P8, P9 at the proper locations, they firstly have to be inserted between a beam 4, 5 of one terminal and a beam 5, 4 of an adjacent terminal. However, because of the requirement to waste as little material as possible during the stamping step adjacent terminals 1 will be as close as possible, thus, leaving only a limited space available for inserting punches 70, 71 between them. Therefore, the method of polishing contact surfaces as described with reference to FIGS. 5*a* and 5*b*, is preferred. One way of avoiding this difficulty of limited available space would be to turn the individual contact terminals 1, e.g. by 90°, before the polishing step. However, this would require an additional process step.

It is to be understood that the present invention is not limited to the embodiments illustrated above. The method to polish and possibly broaden rough, burred contact surfaces resulting from stamping processes may be applied on any shaped terminal intended for electrically contacting any type of mating contact area, e.g., from a mating contact terminal, the plating hole in a printed circuit board, etc.

What is claimed is:

1. A method of producing a dual beam contact terminal having first and second spaced terminal beams formed from a blank, said contact terminal comprising first and second oppositely spaced contact surfaces extending substantially transverse to a plane of symmetry of said contact terminal, wherein a tool is inserted between said spaced contact surfaces, said tool having opposite polished surfaces extending substantially parallel to said plane of symmetry, and said contact surfaces are pressed against an adjacent polished surface of said support tool, said opposite surfaces having a predetermined accurately controlled mutual distance, such that by pressing said contact surfaces with a predetermined force against said support tool by first and second punches which are movable relative to one another in a direction substantially transverse to said first and second contact surface to create dimples in said first and second terminal beams, polished contact surfaces are obtained having an accurately controlled predetermined mutual distance for receiving and contacting a mating contact terminal, wherein said opposite surfaces of said tool define a substantially V-shaped cross section having a tapered end, and wherein said support tool with its tapered end is inserted between and withdrawn from said contact surfaces in opposite directions along said plane of symmetry.

2. A method according to claim 1, wherein said surfaces of said tool are shaped such that contact surfaces are produced having a substantially rectilinear line of intersection between a contact surface and a plane of cross section through said contact terminal and perpendicular to said plane of symmetry.

3. A method according to claim 1, wherein said surfaces of said tool are shaped such that contact surfaces are produced having a substantially curved line of intersection between a contact surface and a plane of cross section through said contact terminal and perpendicular to said plane of symmetry.

4. A method according to claim 1, wherein a plurality of contact terminals are formed from a blank such that said contact surfaces of said contact terminals are adjacently stacked, wherein a comb-like support tool is provided having a plurality of opposite surfaces for simultaneously producing a plurality of polished contact surfaces having an accurately controlled predetermined mutual distance.

5. A method according to claim 1, wherein said predetermined force is exerted such that contact surfaces are produced having a predetermined shape.

6. A method according to claim 5, wherein said predetermined force is exerted such that contact surfaces are produced having a width greater than a width of said terminal beams in a direction substantially parallel to said plane of symmetry.

7. A method according to claim 1, wherein a plurality of contact terminals are formed from a blank such that said contact surfaces of said contact terminals are adjacently stacked, wherein a comb-like tool is provided having a plurality of polished contact surfaces having an accurately controlled predetermined mutual distance using a plurality of in-line arranged first and second punches cooperating with said comb-like support tool.

8. A method according to claim 7, wherein said predetermined force is exerted by first and second punches which are moved relative to one another in a direction substantially transverse to said plane of symmetry.

9. A method as in claim 8, wherein said punches simultaneously press said contact surfaces against side opposite surfaces of said tool.

10. A method according to claim 8, wherein a plurality of contact terminals are formed from a blank such that said contact surfaces of said contact terminals are adjacently stacked, wherein a comb-like support tool is provided having a plurality of opposite surfaces for simultaneously producing a plurality of polished contact surfaces having an accurately controlled predetermined mutual distance using a plurality of in-line arranged first and second punches cooperating with said comb-like support tool.

11. A method according to claim 1, wherein said contact surfaces are polished and spaced under heated conditions.

12. A method according to claim 1, wherein said first and second spaced terminal beams comprise a junction portion opposite said first and second contact surfaces, wherein said junction portion is polished and shaped by pressing said terminal beams at their junction portion with a predetermined force against a further support tool having a highly polished surface.

13. A method according to claim 12, wherein said junction portion is provided with an enlarged width in a direction substantially parallel to said plane of symmetry of said contact terminal.

14. A method according to claim 1, wherein said contact terminal is a press-fit terminal having an insert part comprising third and fourth contact surfaces arranged for a press-fit connection to a plated hole of a printed circuit board, wherein said third and fourth contact surfaces are produced by pressing said contact surfaces against a polished surface of a further support tool, thereby polishing said third and fourth contact surfaces.

15. A method according to claim 14, wherein said surfaces of said further support tool are shaped such that third and fourth contact surfaces are produced having a substantially rectilinear line of intersection between such contact surface and a plane of cross section through said contact terminal and perpendicular to said plane of symmetry.

16. A method according to claim 14, wherein said surfaces of said further support tool are shaped such that third and fourth contact surfaces are produced having a substantially curved line of intersection between such contact surface and a plane of cross section through said contact terminal and perpendicular to said plane of symmetry.

17. A method of working a terminal, comprising the steps of:

providing a terminal made from a conductive material;

providing a central support tool, said central support tool having a polished surface;

providing lateral punches;

placing said central support tool adjacent said terminal; and driving said lateral punches against said terminal to form dimples;

wherein the driving step flows at least some of said material from a location of said dimple towards said central support tool to create a polished mating surface.

18. Tooling for producing a dual beam contact terminal, comprising:

a central support tool having polished opposite surfaces and a predetermined accurately controlled mutual distance between said opposite surfaces; and lateral punches flanking said central support tool, said punches providing dimples to the terminal.

19. Tooling according to claim 18, wherein said opposite surfaces of said support tool define a substantially V-shaped cross section having a tapered end.

20. Tooling according to claim 18, and further comprising first and second punches movable in a direction to and from said opposite surfaces.

* * * * *